US009841703B2

(12) United States Patent
Ishida et al.

(10) Patent No.: US 9,841,703 B2
(45) Date of Patent: Dec. 12, 2017

(54) DEVELOPING APPARATUS

(71) Applicant: CANON KABUSHIKI KAISHA, Tokyo (JP)

(72) Inventors: Yusuke Ishida, Toride (JP); Takanori Iida, Noda (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/234,106

(22) Filed: Aug. 11, 2016

(65) Prior Publication Data

US 2017/0052482 A1 Feb. 23, 2017

(30) Foreign Application Priority Data

Aug. 20, 2015 (JP) ..... 2015-163112

(51) Int. Cl.
*G03G 15/08* (2006.01)

(52) U.S. Cl.
CPC ..... *G03G 15/0891* (2013.01); *G03G 15/0844* (2013.01)

(58) Field of Classification Search
CPC ..... G03G 15/0893; G03G 15/0844; G03G 15/0877; G03G 2215/0838; G03G 2215/0822
(Continued)

(56) References Cited

U.S. PATENT DOCUMENTS 7,483,657 B2 1/2009 Ishida
8,611,797 B2 12/2013 Maeda et al.
(Continued)

FOREIGN PATENT DOCUMENTS

JP 2010-256701 A 11/2010
JP 2011-203330 A 10/2011
(Continued)

OTHER PUBLICATIONS

Translation of Sato (JP 10095119 A) listed in the IDS, publication date: Apr. 14, 1998.*
(Continued)

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A developing apparatus includes a developing container containing a developer and a stirring-conveying screw configured to feed the developer. The stirring-conveying screw includes a first feeding screw portion to feed the developer in a first direction, a second feeding screw portion to feed the developer in an opposite direction, and a third feeding screw portion. A first feeding passageway accommodates parts of the feeding screw portions, and a second feeding passageway is provided in fluid communication with the first feeding passageway. A bottom surface portion is disposed proximate to the communication opening and has a first portion provided at a position higher than a bottom surface of the second feeding screw and a second portion provided at a position lower than a bottom-most portion of the communication opening. The bottom surface portion is located downstream of the second feeding screw and faces the third feeding screw.

7 Claims, 7 Drawing Sheets

(58) Field of Classification Search
USPC ..... 399/257
See application file for complete search history.

(56) References Cited

U.S. PATENT DOCUMENTS

| | | | | |
|---|---|---|---|---|
| 9,217,957 | B2 | 12/2015 | Ishida | |
| 9,316,948 | B2 | 4/2016 | Tsukijima et al. | |
| 9,405,229 | B1 | 8/2016 | Nose et al. | |
| 2011/0076056 | A1* | 3/2011 | Sato | G03G 21/12 399/120 |
| 2011/0236074 | A1* | 9/2011 | Maeda | G03G 15/0893 399/254 |
| 2015/0139696 | A1 | 5/2015 | Ishida et al. | |

FOREIGN PATENT DOCUMENTS

| | | | |
|---|---|---|---|
| JP | 2015-096891 | A | 5/2015 |
| JP | 2015-132803 | A | 7/2015 |

OTHER PUBLICATIONS

Takanori Iida et al., U.S. Appl. No. 15/233,049, filed Aug. 10, 2016.
Yusuke Ishida et al., U.S. Appl. No. 15/232,153, filed Aug. 9, 2016.

* cited by examiner

DEVELOPING APPARATUS

FIELD OF THE INVENTION AND RELATED ART

The present invention relates to a developing apparatus (device) which develops an electrostatic image formed on an image bearing member, with the use of developer.

In the field of an electrophotographic image forming apparatus, those which use two-component developer, the primary components of which are toner and carrier, have been well known. In an electrophotographic image forming apparatus structured to use the abovementioned two-component developer, the toner in developer is consumed by image formation, and therefore, the apparatus is replenished to compensate for the toner consumption. Thus, the toner in two-component developer is gradually replaced with a fresh supply of toner. In principle, the carrier in developer is not consumed by image formation. Therefore, as an image forming operation continues, the carrier in the apparatus gradually deteriorates in its ability to become charged. Therefore, various methods have been known for keeping the carrier in the apparatus stable in its ability to become charged. One of such methods is an ACR method. According to this method, not only is an image forming apparatus replenished with a mixture of toner and carrier, but also, an excessive amount of developer in the developing device is discharged from the developer container to automatically replace the old carrier in the developing device with a fresh supply of carrier.

There is disclosed in Japanese Laid-open Patent Application No. 2010-256701, a developing device structured so that the excessive amount of developer in the device is discharged though an opening, with which the downstream end of the developer conveyance passage in the developer container is provided. In the case of the developing device structure disclosed in Japanese Laid-open Patent Application No. 2010-256701, a reversal conveyance screw for conveying developer in the developer conveyance passage, in the opposite direction from a main conveyance screw, is provided on the downstream side of the main conveyance screw. Further, the developing device is structured so that the bottommost point of the abovementioned opening is positioned higher than the bottommost point of the inward surface of the main conveyance passage. In operation, as a certain portion of developer in the developing device is conveyed beyond the reversal conveyance screw, this portion of developer is discharged through a developer discharge passage.

In the case of the developing device structure disclosed in Japanese Laid-open Patent Application No. 2010-256701, the bottommost point of the opening and the bottommost point of the inward surface of the conveyance passage are different in position in terms of vertical direction. That is, there is a stairstep between the conveyance passage and opening. Therefore, the developer in the adjacencies of this stairstep becomes stagnant, or hardly moves. That is, there is a developer stagnation area between the conveyance passage and opening. If developer remains in the developer stagnation area for a substantial length of time, it sometimes agglomerates. More concretely, the developer stagnation area is likely to be increased in temperature by the heat generated by the bearing by which the discharge passage side of the conveyance screw is supported. As the developer stagnation area is increased in temperature, the developer in the developer stagnation area sometimes becomes agglutinated.

As the developer in the developer stagnation area become agglutinated, it is possible that as the developing device vibrates when the image forming apparatus is moved, or one of the units in the apparatus is replaced, the agglutinated developer will enter the passage through which the developer is re-circulated in the developing device. Once the agglutinated developer enters the re-circulation passage, it is possible that the agglutinated developer will be used for development, and cause the image forming apparatus to output images which are inferior in appearance.

The present invention was made in consideration of the above-described issue. Thus, the primary object of the present invention is to realize a developing device structure which can prevent developer from becoming stagnant in the adjacencies of the stairstep between the bottommost point of the inward surface of the developer discharge opening and the bottommost point of the inward surface of the developer conveyance passage.

SUMMARY OF THE INVENTION

According to an aspect of the present invention, there is provided a developing apparatus comprising a developer container configured to contain a developer; a feeding screw configured to feed the developer in a first direction in said developer container; a returning screw provided at a position downstream of said feeding screw with respect to the first direction and configured to feed the developer in a second direction opposite to the first direction; an opening provided in a downstream side end surface of a feeding path in which said feeding screw is provided, said opening being disposed at the position higher than a bottom surface of an opposing area to which said feeding screw of said feeding path is opposed, and said opening being capable of permitting discharge of an excessive developer resulting from supplying operation of the developer into said developer container; and a higher bottom portion provided between said end surface and an upstream end portion of said returning screw with respect to the second direction and having a surface higher than the bottom surface of the opposing area and lower than a lower end of said opening.

Further features of the present invention will become apparent from the following description of exemplary embodiments with reference to the attached drawings.

Figure 7:
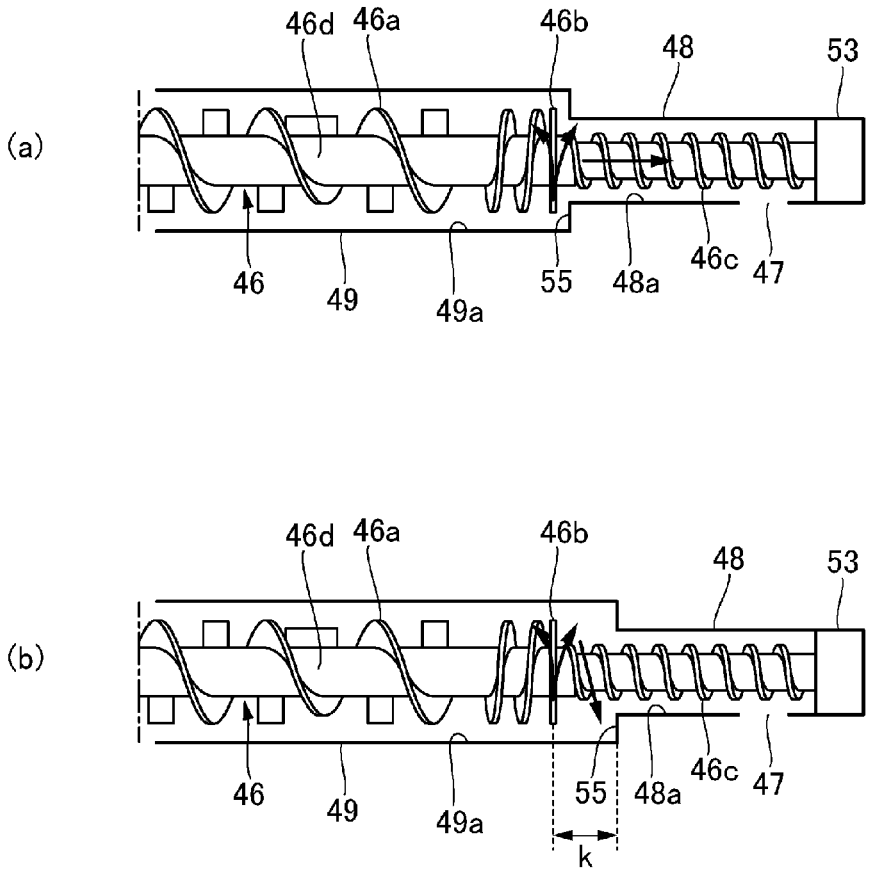

Part (a) of FIG. 7 is a schematic drawing of the downstream end portion of the conveyance screw of a comparative (conventional) developing device, the reverse conveyance portion of which is close to the stairstep portion between the conveyance passage and discharge passage, and part (b) of FIG. 7 is a schematic drawing of the downstream end portion of the conveyance screw of the comparative (conventional) developing device, the reversal conveyance portion of which is relatively distant from the stairstep portion.

Figure 8:
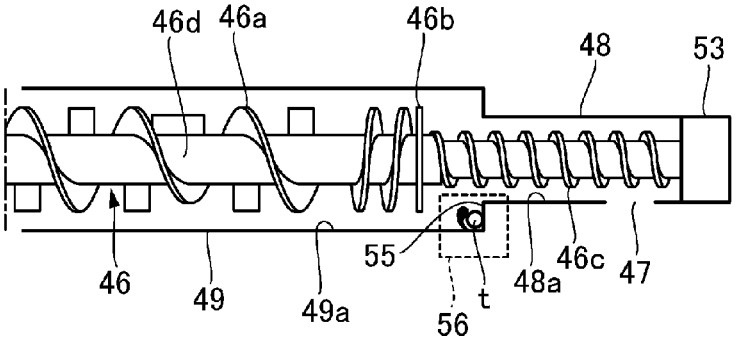

FIG. 8 is a schematic drawing for describing the developer stagnation which occurs to a developing device structured like the one shown in part (a) of FIG. 7.

Figure 9:
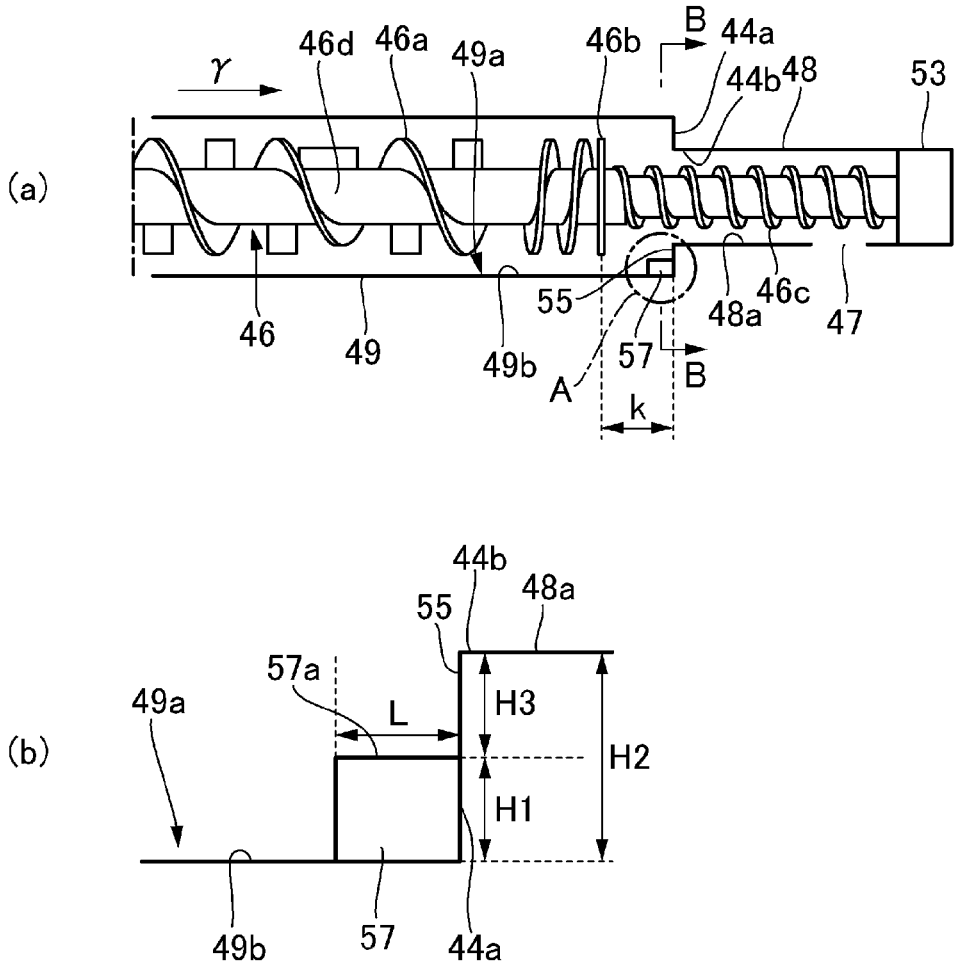

FIG. 9 (a) is a schematic drawing of a part of the developing device in the first embodiment, and part (b) of FIG. 9 is an enlarged view of a portion A in part (a) of FIG. 9.

Figure 10:
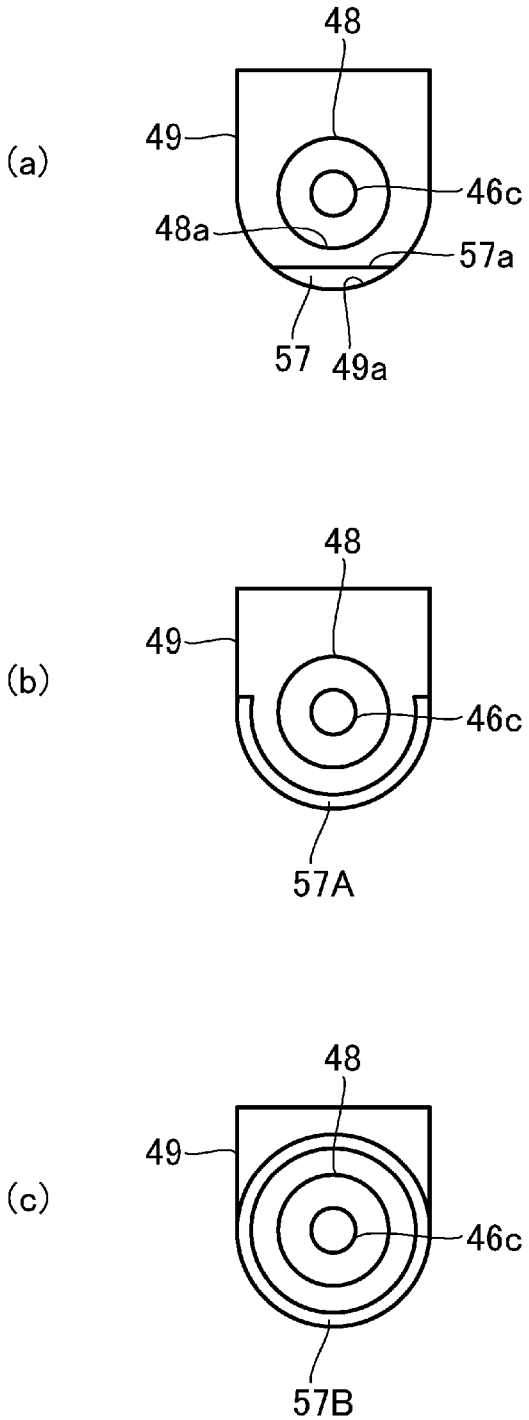

FIG. 10 is a sectional view of the developing device in the first embodiment, at a plane B-B in part (a) of FIG. 9, part (a) of FIGS. 10, 10(*b*) and 10(*c*) representing the first, second, and third versions, respectively, of the first embodiment.

Figure 11:
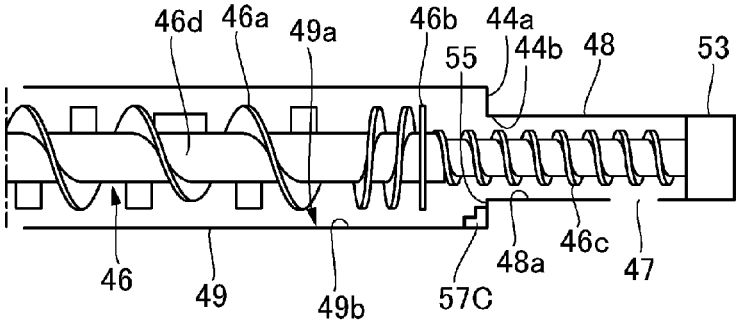

FIG. 11 is a schematic drawing of a part of another version of the first embodiment.

Figure 12:
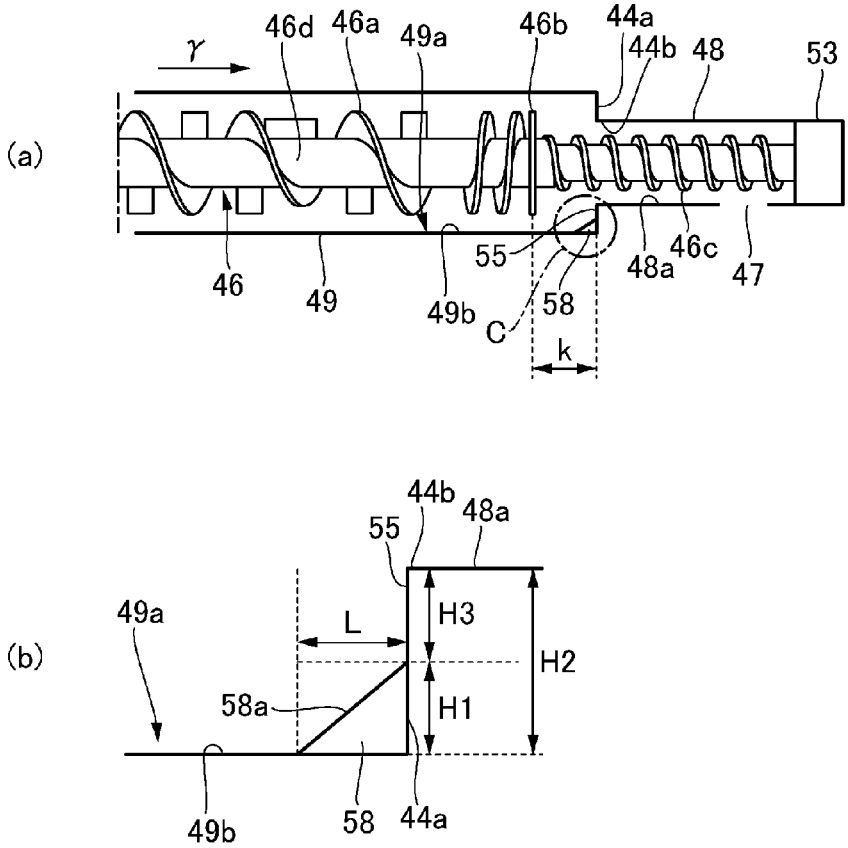

Part (a) of FIG. 12 is schematic drawing of a part of the developing device in the second embodiment of the present invention, and part (b) of FIG. 12 is an enlarged view of a portion C in part (a) of FIG. 12.

DESCRIPTION OF THE EMBODIMENTS

Hereafter, referring to FIGS. 1-11, the first embodiment of the present invention is described. To begin with, the general structure of the image forming apparatus in this embodiment is described with reference to FIG. 1.

[Image Forming Apparatus]

An image forming apparatus 100 is an electrophotographic full-color printer. It has four image forming portions 1Y, 1M, 1C and 1Bk which correspond to yellow, magenta, cyan, and black color, respectively. It is of the so-called tandem type. That is, the image forming portions 1Y, 1M, 1C and 1K are aligned in tandem in the direction parallel to the rotational direction of an intermediary transfer belt 16, which will be described later. The image forming apparatus 100 forms a toner image (image formed of toner) on a sheet P of recording medium, in response to image formation signals sent from an original reading device (unshown), which is in connection to the main assembly of the image forming apparatus 100, or a host device, such as a personal computer, which is in connection to the main assembly so that signals can be transmitted between the host device and main assembly. As recording medium, a sheet of ordinary paper, plastic film, fabric, etc., can be listed.

Next, the image formation process of the image forming apparatus 100 is generally described. First, yellow, magenta, cyan and black toner images are formed on photosensitive drums (electrophotographic photosensitive members) 2Y, 2M, 2C and 2Bk, which are image bearing members, in the image forming portions 1Y, 1M, 1C and 1Bk, respectively. Then, the four toner images, different in color, are transferred onto the intermediary transfer belt 16, and then, are transferred from the intermediary transfer belt 16 onto a sheet P of recording medium. After the transfer of the toner images onto the sheet P, the sheet P is conveyed to a fixing device 13, in which the toner images are fixed to the sheet P. Next, these steps are described in detail.

By the way, the four image forming portions 1Y, 1M, 1C and 1Bk with which the image forming apparatus 100 is equipped are practically the same in structure, although they are different in the color of the toner they use. Therefore, only the image forming portion 1Y is described; other image forming portions are not described.

Figure 1:
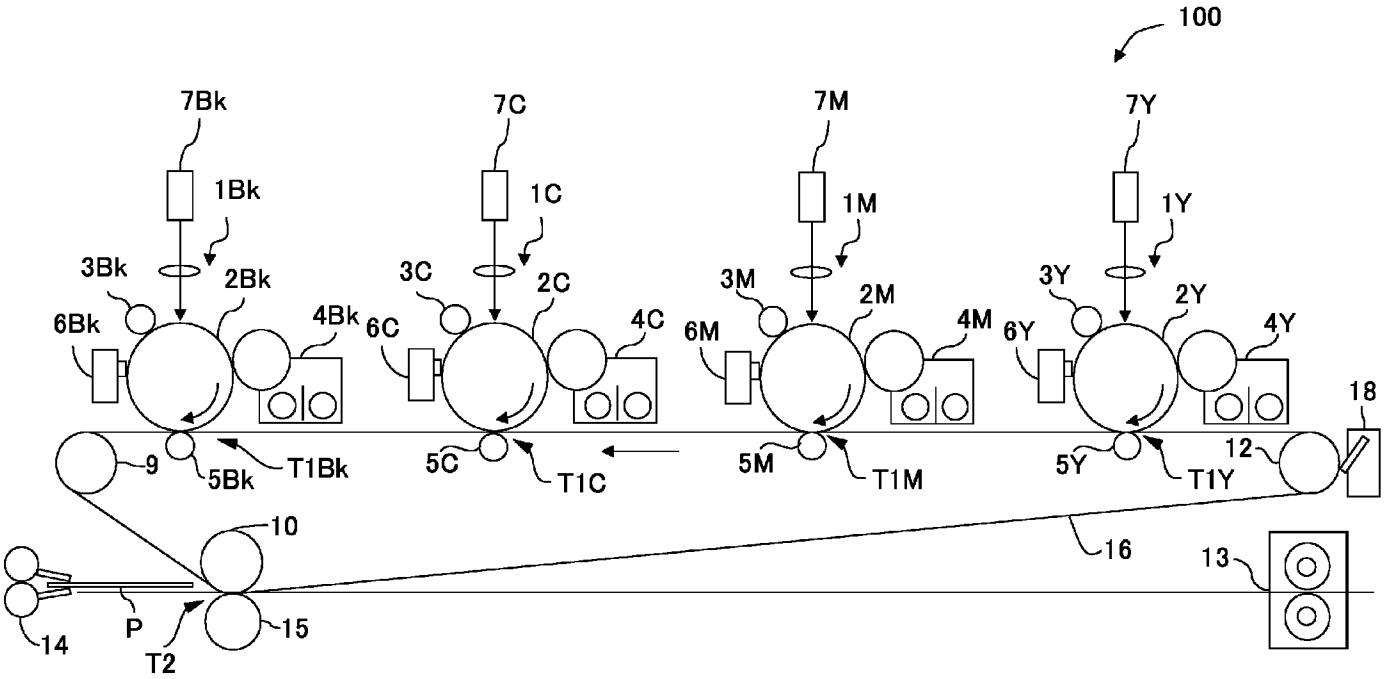
FIG. 1 is a schematic sectional view of the image forming apparatus in the first embodiment of the present invention, which shows the general structure of the apparatus.

In the image forming portion 1Y, a photosensitive drum 2Y is disposed as an image bearing member, which is a cylindrical photosensitive member. The photosensitive drum 2Y is rotationally driven in the direction indicated by an arrow mark in FIG. 1. In the adjacencies of the peripheral surface of the photosensitive drum 2Y, a charge roller 3Y (charging device), a developing device 4Y, a primary transfer roller 5Y, and a cleaning device 6Y are disposed. Above the photosensitive drum 2Y, a laser scanner (exposing device) 7Y is disposed as shown in FIG. 1.

Further, the intermediary transfer belt 16 is disposed so that it opposes all the photosensitive drums 2Y, 2M, 2C and 2Bk. It is suspended and kept tensioned by a combination of a driver roller 9, a secondary transfer inward roller 10, and an idler roller 12. It is circularly driven by the driver roller 9 in the direction indicated by an arrow mark in FIG. 1. There is disposed a secondary transfer outward roller 15 so that it opposes the secondary transfer inward roller 10 with the presence of the intermediary transfer belt 16 between itself and the secondary transfer inward roller 10. The secondary transfer inward roller 10 and secondary transfer outward roller 15 form a secondary transfer portion T2 in which the toner images on the intermediary transfer belt 16 are transferred onto a sheet P of recording medium. On the downstream side of the secondary transfer portion T2 in terms of the recording medium conveyance direction, the fixing device 13 is disposed.

Next, the process through which an image is formed by the image forming apparatus 100 structured as described above is described. As an image forming operation is started, first, the peripheral surface of the rotating photosensitive drum 2Y is uniformly charged by the charge roller 3Y. Then, the peripheral surface of the photosensitive drum 2Y is exposed to a beam of laser light emitted from the exposing device 7Y while being modulated with the image formation signals. As a result, an electrostatic latent image, which reflects the image formation signals, is effected on the peripheral surface of the photosensitive drum 2Y. Then, the electrostatic latent image on the photosensitive drum 2Y is developed into a visible image by the toner stored in the developing device 4Y.

The toner image formed on the photosensitive drum 2Y is transferred (primary transfer) onto the intermediary transfer belt 16, in the primary transfer portion T1Y, which is the area of contact between the photosensitive drum 2Y, and the intermediary transfer belt 16 which is kept pressed upon the photosensitive drum 2Y by the primary transfer roller 5Y. The toner (transfer residual toner) which is remaining on the peripheral surface of the photosensitive drum 2Y after the primary transfer is removed by the cleaning device 6Y.

The above-described process is sequentially carried out in the image forming portions 1M, 1C and 1Bk, which correspond to magenta, cyan, and black colors, respectively. Consequently, four toner images, different in color, are layered upon the intermediary transfer belt 16. Meanwhile, one of the sheets P of recording medium stored in a recording medium storage cassette (unshown) is conveyed to the secondary transfer portion T2, with such timing that it arrives at the secondary transfer portion T2 at the same time as the toner images on the intermediary transfer belt 16. Then, as the sheet P is conveyed through the secondary transfer portion T2, along with the four toner images, different in color, on the intermediary transfer belt 16, the four toner images are transferred together (secondary transfer) onto the sheet P. The toner which failed to be transferred onto the sheet P in the secondary transfer portion T2, and therefore, is remaining on the intermediary transfer belt 16 after the secondary transfer, is removed by an intermediary transfer belt cleaning device 18.

Then, the sheet P is conveyed to the fixing device 13, by which heat and pressure are applied to the sheet P and the toner images thereon. As the heat and pressure are applied, the toner on the sheet P melts and mixes, yielding thereby a full-color image, and then, becomes fixed to the sheet P. Thereafter, the sheet P is discharged from the main assembly of the image forming apparatus 100, ending the image formation process (image formation sequence). By the way, the image forming apparatus 100 can be used to form a monochromatic image of a desired color, or multicolor image of two or more colors, with the use of only the image forming portion which corresponds to the desired color, or the image forming portions which correspond to the desired colors, one for one.

[Developing Device]

Next, referring to FIGS. 2-6, the developing device 4Y in this embodiment is described. As described above, in this embodiment, the four developing devices for yellow, magenta, cyan, and black color, one for one, are the same in structure. Therefore, the developing devices 4M, 4C and 4Bk are not described. The developing device 4Y has a developer container 40 which stores two-component developer (which hereafter will be referred to simply as developer), the primary components of which are nonmagnetic toner particles (toner) and magnetic carrier particles (carrier). By the way, in this embodiment, the ratio between the toner and carrier in the developer is roughly 1:9 in weight. This ratio is to be adjusted according to the amount of toner charge, carrier particle diameter, structure of the image forming apparatus 100, etc. That is, it is not mandatory that the ratio is roughly 1:9.

The developer container 40 of the developing device 4Y has an opening, which faces the photosensitive drum 2Y, in the development area. Further, the developing device 4Y is provided with a development sleeve 42, as a rotatable developer bearing member, which is partially exposed toward the photosensitive drum 2Y though the opening. Further, there is disposed a stationary magnet 41 in the development sleeve 42. The development sleeve 42 is formed of a nonmagnetic substance. It is rotated in the direction indicated by an arrow mark α in FIG. 3, during a development operation. As it is rotated, it bears the two-component developer in the developer container 40, in a thin layer, and conveys the developer to the development area, in which it supplies the photosensitive drum 2Y with the developer, developing thereby the electrostatic latent image formed on the photosensitive drum 2Y. The developer remaining on the development sleeve 42 after the development of the latent image is recovered into the developer container 40 by the rotation of the development sleeve 42.

Figure 3:
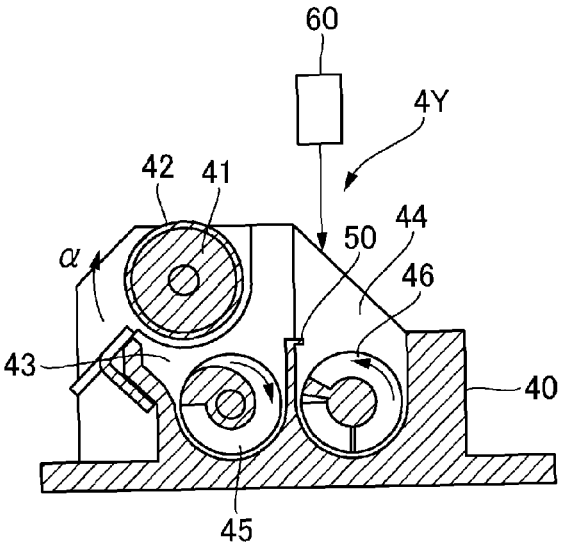
FIG. 3 is a cross-sectional view of the developing device in the first embodiment.

There are a development chamber 43 as the first chamber, and a stirring chamber 44 as the second chamber. The developer is storable in the development chamber 43 as well as in the stirring chamber 44. The two chambers 43 and 44 are in connection to each other, forming a circulation passage through which the developer is circularly moved in the developer container 40. Further, the developing device 4Y is provided with the developer stirring-conveying first and second screws 45 and 46, as conveying members for conveying developer in the development chamber 43 and stirring chamber 44, which are disposed in the development chamber 43 and stirring chamber 44, respectively. Further, the stirring chamber 44 is provided with an unshown inlet, through which the stirring chamber 44 is replenished with replenishment developer which is a mixture of toner and carrier, from a developer supplying device 60 (FIG. 3).

Figure 2:
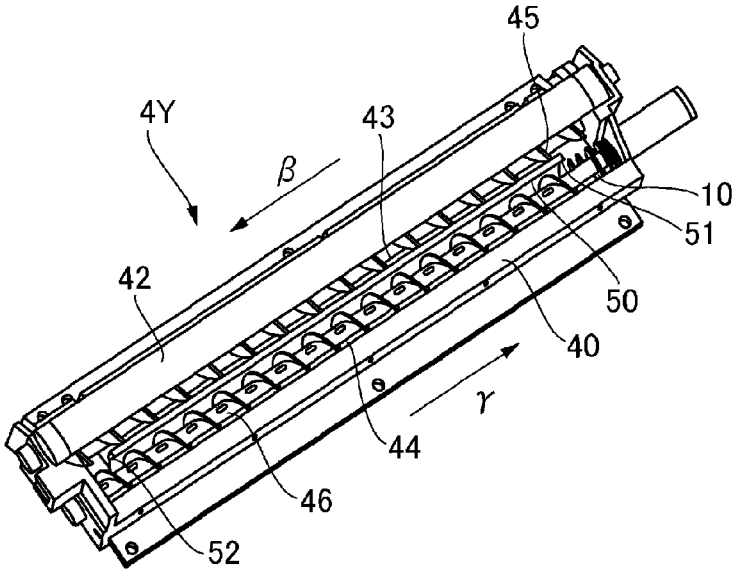
FIG. 2 is a perspective view of the developing device in the first embodiment.

There is a partition wall 50 between the development chamber 43 and stirring chamber 44. Referring to FIG. 2, the lengthwise end portions of the partition wall 50 are provided with openings 51 and 52, one for one. In the development chamber 43 and stirring chamber 44, the two-component developer is conveyed by the first and second stirring-conveying screws 45 and 46, respectively, while being stirred and mixed, so that the developer is circularly moved in the developer container 40. Regarding the developer conveyance direction, in the development chamber 43, the developer is conveyed in the direction indicated by an arrow mark β in FIG. 2, whereas in the stirring chamber 44, the developer is conveyed in the direction (first direction) indicated by an arrow mark γ. That is, the two chambers 43 and 44 are opposite in the developer conveyance direction.

Figure 4:
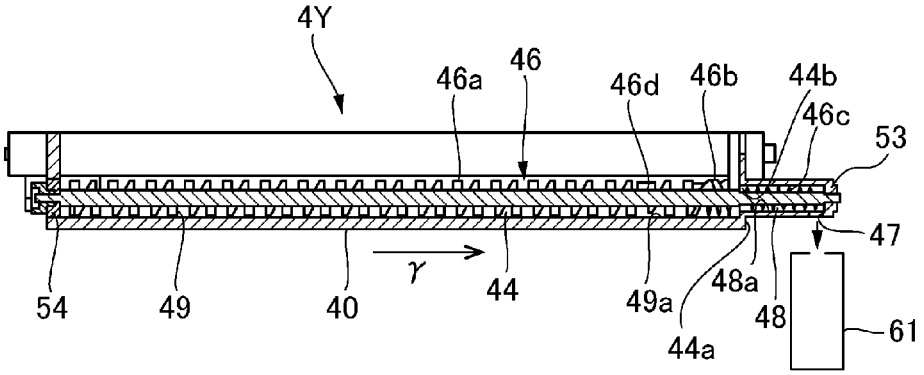
FIG. 4 is a vertical sectional view of the developing device in the first embodiment.

Next, referring to FIG. 4, the stirring chamber 44 is provided with a discharge opening 47, through which the developer in the stirring chamber 44 is discharged. In terms of the developer conveyance direction in the stirring chamber 44, the discharge opening 47 is on the downstream side of the stirring chamber 44. It is outside the developer circulation path. The downstream end portion of the stirring chamber 44 in terms of the developer conveyance direction is in connection to the discharge passage 48. Also in terms of the developer conveyance direction, the downstream end portion of the discharge passage 48 is provided with a discharge outlet 47, which opens downward when the developing device is properly positioned in the main assembly of the image forming apparatus 100. In other words, the downstream wall 44*a* of the stirring chamber 44 in terms of the developer conveyance direction is provided with an opening 44*b* for discharging the developer. This opening 44*b* is in connection to the abovementioned discharge passage 48. That is, the discharge passage 48 conveys the developer having passed the opening 44*b*, and discharges the developer through the discharge outlet 47.

Figure 5:
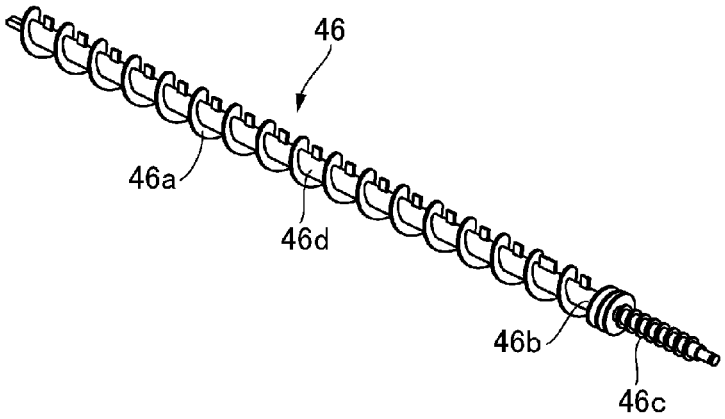
FIG. 5 is a perspective view of a conveyance screw in the first embodiment.
Figure 6:
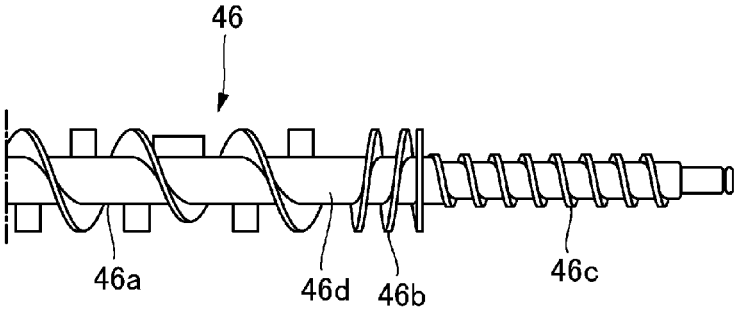
FIG. 6 is a side view of a part of the conveyance screw in the first embodiment.

Referring to FIGS. 4-6, the second stirring-conveying screw 46 is structured so that it conveys developer from the stirring chamber 44 to the discharge outlet 47 as described above. That is, referring to FIG. 5, a primary screw 46*a*, a reversal conveyance screw 46*b*, and a discharge screw 46*c* share a single rotational shaft 46*d*, making up the second stirring-conveying screw 46. More concretely, each screw is a spiral blade attached to the rotational shaft 46*d*. Further, the second stirring-conveying screw 46 is disposed so that the primary conveyance screw 46*a* is positioned in the conveyance passage 49, through which developer is conveyed in the stirring chamber 44. It conveys the developer in the stirring chamber 44 in the direction indicated by the arrow mark γ (first direction) in FIG. 4, that is, toward the discharge passage 48.

In terms of the first direction, the reverse screw 46*b* is on the downstream side of the primary screw 46*a*, in the conveyance passage 49. It conveys developer in the second direction, which is the opposite direction from the developer conveyance direction of the primary screw 46*a*, on the upstream side of the discharge passage 48 of the conveyance passage 49. Here, "conveys in the opposite direction" does not means "conveys the entirety of developer in the opposite direction". It means "conveys a part of the developer in the opposite direction". The discharge screw 46*c* (inclusive of rotational shaft 46*d*) is disposed in the discharge passage 48, which will be described next). It conveys the developer conveyed from the stirring chamber 44 to the discharge passage 48 beyond the reverse screw 46*b*, toward the discharge outlet 47. The conveyance direction of the discharge screw 46*c* is the same as that of the primary screw 46*a*.

On the downstream side of the combination of the primary screw 46*a* and reverse screw 46*b* in terms of the first direction, the discharge passage 48, through which excessive amount of developer in the development cartridge, is disposed in connection to the developer conveyance passage 49. The position of the bottommost point of the inward surface 48*a* (second surface) of the discharge passage 48 is higher than the position of the bottommost point of the inward surface 49*a* (first surface) of the conveyance passage 49. That is, developing device 4Y is structured so that the position of the bottommost point of the inward surface 48*a* (second surface) of the discharge passage 48 is higher than the position of the bottommost point of the inward surface 49*a* (first surface) of the conveyance passage 49. In other words, it is the downstream wall of the stirring chamber 44 in terms of the developer conveyance direction in the stirring chamber 44 in which the second stirring-conveying screw 46 is present, that is provided with the opening 44*b*. The opening 44*b* is for accommodating the rotational shaft of the second stirring-conveying screw 46, and also, for allowing the excessive amount of developer in the developer container 40 to be discharged. By the way, the position of the bottommost point of the opening 44*b* is higher than the position of the bottommost point of the inward surface 49*a* (first surface) of the conveyance passage 49 of the stirring chamber 44 in which the primary screw 46*a* and reverse screw 46*b*, which are opposite in the developer conveyance direction, are present.

Here, the position of the first bottommost point of the inward surface 49*a* of the conveyance passage 49 is lower than the lowest point of the reverse screw 46*b*. Further, the position of the bottommost point of the inward surface 48*a* of the discharge passage 48 is lower than the position of the lowest point of the discharge screw 46*c*.

More concretely, referring to part (a) of FIG. 10 which will be described later, the conveyance passage 49 is in the shape of a trough which is U-shaped in cross-section. That is, it is made up of a semi-cylindrical bottom portion, the center of radius of which roughly coincides with the axial line of the rotational shaft 46*d*, and a pair of vertical walls which are in connection to the top edges of the semi-cylindrical bottom portion and extend along the top edges of the bottom portion, one for one. The discharge passage 48 is cylindrical, and its axial line coincides with the rotational axis of the second stirring-conveying screw 46. It is in connection to the downstream end wall of the conveyance passage 49 in terms of the developer conveyance direction of the conveyance passage 49. The internal diameter of the discharge passage 48 is smaller than the external diameter of the reverse screw 46*b*. The bottommost point of the first inward surface 49*a* is the portion of the conveyance passage 49, the position of which is lower than the position of the bottommost point of the second inward surface 48*a*, that is, the bottommost point of the inward surface of the discharge passage 48. It is the portion of the conveyance passage 49, which overlaps with the hypothetical extension of the discharge passage 48 into the conveyance passage 49, as the conveyance passage 49 is seen from above.

Further, the lengthwise ends of the second stirring-conveying screw 46 are rotatably supported by the developer container 40 with the placement of a pair of bearings 53 and 54 between the shaft of the second stirring-conveying screw 46 and the developer container 40. The bearing 53 rotatably supports the lengthwise end of the rotational shaft 46*d* of the second stirring-conveying screw 46, which is on the downstream side of the discharge screw 46*c* in terms of the first direction, so that the second stirring-conveying screw 46 is rotatable relative to the wall of the discharge passage 48. In other words, developing device 4 is structured so that, in terms of the first direction, the bearing 53 is positioned on the downstream side of the opening 44*b*, to rotatably support the second stirring-conveying screw 46. In this embodiment, a pair of resin bearings formed of POM (polyoxymethylene) were employed as the bearings 53 and 54. However, this embodiment is not intended to limit the present invention in terms of the choice of the material for the bearings 53 and 54.

Next, the developing device 4 in this embodiment structured as described above is described about its operation through which it is replenished with developer, and its operation through which developer is recovered therefrom. What is used as the replenishment developer in this embodiment is such developer that contains carrier by a preset ratio (roughly 10% in weight ratio). However, the ratio does not need to be the same as the one in this embodiment. As the toner in the developer in the developing device 4 is consumed by image formation, the developing device 4 is replenished with the abovementioned replenishment developer, which contains carrier by a preset ratio as described above, by an amount equal to the amount by which the toner was consumed, by the rotation of the replenishment screw with which the developer supplying device 60 is provided, from the upstream side of the primary screw 46*a* in the stirring chamber 44 in terms of the developer conveyance direction of the primary screw 46*a*.

As the developing device 4 is replenished with developer so that the developer in the developer container 40 remains stable in toner density at a preset ratio, the amount of the developer in the developer container 40 gradually increases with the continuation of an image forming operation. The toner in the developer container 40 is consumed by an image forming operation, but the carrier in the developer container 40 is not consumed by the image forming operation, and therefore, most of the carrier in the developer container 40 remains in the developer container 40. Since 90% of replenishment developer is toner, and 10% is carrier. Therefore, as the developer container 40 is repeatedly replenished with the replenishment developer, the developer in the developer container 40 gradually increases. As the developer in the developer container 40 increases as described above, a part of the developer which is being conveyed by the primary screw 46*a* of the second stirring-conveying screw 46, moves downstream over the reverse screw 46*b* in terms of the first direction, and reaches the discharge passage 48. Then, this portion of the developer is conveyed to the discharge outlet 47 by the discharge screw 46*c*. Then, it is discharged through the discharge outlet 47, and conveyed to the recovery container 61 to be recovered and stored.

As described above, as the toner in the developing device 4 (developer container 40) is consumed, the developer container 40 is replenished with a fresh supply of toner by the replenishment developer, by an amount equal to the amount of the toner consumption, so that the developer in the developer container 40 remains stable in toner density, while the developer in the developer container 40, which became excessive in carrier content, is discharged by an amount which is proportional to the amount by which the carrier is excessive. That is, the two-component developer in the developer container 40 is gradually and automatically replaced by a fresh supply of replenishment developer, so that the developer in the developer container 40 remains stable in toner density at a preset level.

[Developer]

At this time, the two-component developer stored in the developer container 40, which is a mixture of toner and carrier, is described in detail. Toner is a mixture of coloring particles made up of bonding resin, coloring agent, and additives (which are added as necessary), and particles of external additive, such as microscopic particles of colloidal silica. Toner is made of negatively chargeable polyester resin. It is desired to be no less than 4 μm, and no more than 10 μm, preferably, no more than 8 μm, in volume average particle diameter. The toner used by the image forming apparatus 100 in this embodiment is 6 μm in volume average particle diameter. Further, 10% of the toner particles are no less than 8 μm volume average diameter, and 3% of the toner particles are no less than 9 μm in volume average particle diameter.

As for the material for the carrier, superficially oxidized or un-oxidized particles of a metallic substance such as iron, nickel, cobalt, manganese, chrome, rare earth metal, or the like, their alloys, or oxidized ferrite, etc., can be preferably used. There is no restriction regarding the manufacturing method for these magnetic particles. Carrier is desired to be in a range of 20-60 μm, preferably, 30-50 μm, in weight average particle diameter, and no less than $10^7$ Ω·cm, preferably, $10^8$ Ω·cm, in resistivity. In this embodiment, the carrier was $10^8$ Ω·cm, in resistivity.

Next, referring to the comparative (conventional) developing device shown in FIG. 7, the issues, which a developing device structured so that the developer having moved downstream beyond the reverse screw 46*b* as described above is discharged through the discharge passage 48 has, are described. By the way, the structural components of the developing device shown in FIG. 7, and the portions thereof, are given the same referential codes as those given to the counterparts of the developing device 4 in this embodiment. In the case of a developing device structured as shown in part (a) of FIG. 7, the upstream end (right end in drawing) of the reverse screw 46*b* in terms of the second direction is very close to the stairstep surface 55, or the vertical surface of the stairstep between the bottommost point of the second inward surface 48*a* and the bottommost point of the first inward surface 49*a*. That is, the reverse screw 46*b* is close to the entrance of the discharge passage 48. In this case, as the developer is scooped up by the reverse screw 46*b*, it is easier for the developer to enter the entrance of the discharge passage 48 as indicated by an arrow mark in the drawing.

Thus, a certain portion of the scooped up developer is conveyed to the discharge outlet 47 by the discharge screw 46*c*, making excessive the amount by which the developer is discharged. Eventually, the amount of the developer in the developer container 40 becomes smaller than desirable. Thus, the amount by which the development sleeve 42 is coated with developer reduces. Therefore, the image forming apparatus 100 is likely to output images which are lower in density than a preset level, and/or images which are nonuniform in density.

In comparison, in the case of the developing device structured as shown in part (b) of FIG. 7, the distance between the upstream end (right end in drawing) of the reverse screw 46*b* in terms of the second direction, and the stairstep surface 55, that is, the vertical surface of the stairstep between the bottommost point of the second inward surface 48*a* and the bottommost point of the first inward surface 49*a* is relatively large. That is, the distance between the reverse screw 46*b* and the entrance of the discharge passage 48 is relatively large. Thus, it is unlikely for the developer scooped up by the reverse screw 46*b* as indicated by an arrow mark in part (b) of FIG. 7, to reach the entrance of the discharge passage 48. Therefore, a developing device structured as shown in part (b) of FIG. 7 can prevent the amount by which developer is discharged, from becoming excessive. By the way, from the standpoint of ensuring that the amount by which developer is discharged does not become excessive, the distance k between the upstream end of the reverse screw 46*b* and the stairstep surface 55 (entrance of discharge passage 48) is desired to be no less than 1.5 mm.

However, if the distance between the upstream end of the reverse screw 46*b* and the entrance of the discharge passage 48 is made relatively large as in the case of the developing device structured as shown in part (b) of FIG. 7, developer becomes stagnant, or hardly moves, in an area 56, which hereafter may be referred to as developer stagnation area. That is, in the area 56, which is on the upstream side of the stairstep surface 55, where the bottommost point of the second inward surface 48*a*, that is, the bottommost point of the inward surface of the discharge passage 48, and the bottommost point of the first inward surface 49*a*, or the bottommost point of the inward surface of the conveyance passage 49, are different in position in terms of the vertical direction, it is difficult for developer to be scooped up by the reverse screw 46*b*. That is, once developer enters the developer stagnation area 56, it is unlikely to be moved out of the area 56. Thus, the developer is likely to become stagnant in the area 56. As developer becomes stagnant in the area 54, it (primarily toner) sometimes agglutinates.

The end of the second stirring-conveying screw 46, which is on the discharge passage 48 side, is rotatably supported by the bearing 53. Therefore, this end of the second stirring-conveying screw 46 is sometimes increased in temperature by the friction which occurs as the second stirring-conveying screw 46 supported by the bearing 53 is rotated. As this end portion of the second stirring-conveying screw 46 increases in temperature, the developer t which is remaining stagnant in the area 56 which is in the adjacencies of this end of the second stirring-conveying screw 46, sometimes agglutinates, yielding thereby relatively large particles of toner. These large particles of toner are possibly made to enter the developer circulation path in the developer container 40, by the vibrations of developing device 4 (which occur as main assembly of image forming apparatus 100 is moved, when units in image forming apparatus 100 are replaced, or on the like occasion). As large particles of toner enter the developer circulation path, some of them are used for development, sometimes causing the image forming apparatus 100 to output images which are low in quality. More concretely, the large particles of toner are transferred onto the drum, transferred onto the surface of a sheet P of recording medium, and fixed to the sheet P. Therefore, the image forming apparatus 100 sometimes forms such an image that appears as if large particles of toner were crushed into smaller particles of toner, on the surface of the sheet P, and are scattered across the image (which hereafter may be referred to as image soiled with toner).

[Stairstep Portion (Portion with Raised Bottom)]

Referring to part (a) of FIGS. 9 and 9(*b*), in this embodiment, in order to prevent developer from becoming stagnant in the above-described developer stagnation area, a stairstep portion 57 is provided, as a raised bottom portion, on the upstream side of the stairstep surface 55 in terms of the first direction (indicated by arrow mark γ in drawings). That is, the stairstep portion 57 is sized and positioned so that the position of the bottommost point of the inward surface of the portion of the conveyance passage 49 which corresponds to where the primary screw 46*a* meets the reverse screw 46*b*, becomes higher than the position of the bottommost point of the inward surface of the conveyance passage 49. Further, the stairstep portion 57 is shaped, sized, and positioned so that, in terms of the direction parallel to the rotational axis of the primary screw 46*a*, it extends from a point between the upstream end of the reverse screw 46*b* in terms of the second direction, and the end wall 44*a* provided with the opening 44*b*, to the end wall 44*a*.

The stairstep portion 57 is the downstream end of the bottommost point of the first inward surface 49*a* in terms of the first direction. Further, in terms of the direction parallel to the axial line of the discharge screw 46*c*, the upstream end portion of the discharge screw 46*c* in terms of the developer conveyance direction extends into the conveyance passage 49, at least to the position of the stairstep portion 57. In this embodiment, the discharge screw 46*c* is between a point between the upstream end of the reverse screw 46*b* in terms of the second direction and the stairstep portion 57, and a point in the discharge passage 48. Thus, as the developer is moved downstream over the reverse screw 46*b* into the adjacencies of the stairstep portion 57, it is efficiently conveyed into the discharge passage 48.

Next, referring to part (a) of FIGS. 9 and 10(*a*), the stairstep portion 57 in this embodiment is describe about its shape and structure. It is roughly semi-cylindrical. In terms of the first direction, it has a length of L, and in terms of the vertical direction, it has a height of H1. It is positioned so that in terms of the first direction, it extends upstream by the length L, and its top surface 57*a* is parallel to the first direction, and perpendicular to the stairstep surface 55. Thus, the position of the bottommost point of the second inward surface 48*a* is higher than that of the top surface 57*a* of the stairstep portion 57, and the position of the top surface 57*a* of the stairstep portion 57 is higher than that of the bottommost point of the second inward surface 48*a*. That is, in this embodiment, the developer stagnation area described with reference to FIG. 8 is occupied by the stairstep portion 57 which is shaped, sized, and positioned as described above.

More concretely, also in the case of this embodiment, the distance between the upstream end of the reverse screw 46*b* in terms of the second direction, and the stairstep surface 55 is made relatively large as in the case of the comparative developing device described above with reference to part (b) of FIG. 5. For the purpose of preventing the amount by which developer is discharged becoming excessive, the distance k which is the length of the interval between the stairstep surface 55 (opening 44*b*) and the upstream end of the reverse screw 46*b* in terms of the second direction, is desired to be no less than 1.5 mm. In this embodiment, it is 2.5 mm.

Further, it is desired that the length L of the stairstep portion 57 in terms of the first direction satisfies an inequality: $L/k \geq 20.3$, for the following reason. If L/k is no more than 0.3, the developer stagnation area is created, and therefore, it is difficult to satisfactorily prevent the developer agglomeration, which results in the generation of larger particles of toner. In other words, if L/k is no more than 0.3, the developer stagnation area shown in part (b) of FIG. 7 cannot be satisfactorily filled with the stairstep portion 57. Moreover, it is desired that the stairstep portion 57 satisfies an inequality: $k-L \geq 20.3$ mm, for the following reason. If the distance between the upstream end of the reverse screw 46*b* in terms of the second direction and the stairstep portion 57 is excessively small, it is possible that developer will agglomerate into larger particles in the area between the reverse screw 46*b* and stairstep portion 57.

Further, it is desired that an inequality: $H1/H2 \geq 0.3$ is satisfied, wherein, H1 stands for the height of the top surface 57*a* of the stairstep portion 57, that is, the maximum height of the stairstep portion 57 relative to the bottommost point of the first inward surface 49*b*, on the upstream side of the stairstep portion 57, and H2 stands for the height of the bottommost point of the second inward surface 48*a* (height of bottommost point of inward surface of opening 44*b*) relative to the bottommost point of the first inward surface 49*b*, for the following reason. If H1/H2 is no more than 0.3, the developer stagnation area is created, and therefore, it is difficult to satisfactorily prevent the problem that the stagnant developer in the developer stagnation area agglutinated into larger particles of toner. In other words, if H1/H2 is no more than 0.3, the stairstep portion 57 cannot satisfactorily fill the developer stagnation area shown in part (b) of FIG. 7. Moreover, the height H1 of the stairstep portion 57 is desired to be no less than 1.0 mm. Further, the length L of the stairstep portion 57 is also desired to be no less than 1.0 mm.

If the length L of the stairstep portion 57 is relatively short, the developing device 4 is desired to be structured as follows. That is, it is desired that the height H3 of the bottommost point of the second inward surface 48*a* of the discharge passage 48, relative to the top surface 57*a* of the stairstep portion 57 is no less than 1.0 mm. If the height H3 is no more than 1.0 mm, the stairstep portion 57 is less effective in preventing the amount by which the developer is discharged by being scooped up by the reverse screw 46*b*, from becoming excessive.

By the way, the top surface 57*a* of the stairstep portion 57 may be parallel to the first direction as shown in part (b) of FIG. 9, or tilted in a straight line or in curvature in such a direction that the more downstream it is in terms of the first direction, the higher it is. Further, in this embodiment, the upstream surface 57*a* of the stairstep portion 57 in terms of the first direction is perpendicular to the first inward surface 49*b*. However, this surface also may be tilted in straight line or curvature so that the more downstream it is in terms of the first direction, the higher. In essence, all that is necessary is that the stairstep portion 57 is shaped and positioned so that the bottommost point of the first inward surface 49*a* increases in height in steps toward the stairstep surface 55. That is, the shape of the stairstep portion 57 is optional.

For example, if the stairstep portion 57 is shaped so that in terms of the first direction, the downstream end is lower than its upstream end, it is possible that the space between the downstream end (lower portion) and the stairstep surface 55 becomes a developer stagnation area. Therefore, the stairstep portion 57 is to be shaped so that the top surface of the stairstep portion 57 is level, or tilted in such a direction that the downstream end is higher.

Furthermore, in this embodiment, the developing device 4 is structured so that its sectional view at a plane which perpendicular to the rotational axis 46*d* of the second stirring-conveying screw 46, and coincides with the stairstep portion 57 is as shown in part (a) of FIG. 10. That is, as the conveyance passage 49 is seen from a point which is on the downstream side of the discharge passage 48 of the conveyance passage 49, and above the hypothetical extension of the discharge passage 48 into the conveyance passage 49 in terms of the first direction, the stairstep portion 57 is positioned in the area where the hypothetical extension of the discharge passage 48 overlaps with the conveyance passage 49. As described above, the bottommost point of the first inward surface 49*a* is the portion of the conveyance passage 49, which is on the downstream side of the most downstream end of the reverse screw 46*b*. Therefore, as described above with reference to the part (b) of FIG. 7, the developer in the adjacencies of the bottommost point of the first inward surface 49*a* is unlikely to be scooped up by the reverse screw 46*b*. Therefore, as developer enters the area which is adjacent to the stairstep surface 55 and the bottommost point of the first inward surface 49*a*, it is likely to become stagnant. In this embodiment, therefore, the developing device 4 is provided with the stairstep portion 57.

Regarding the dimension of the area above the top surface 57*a* of the stairstep portion 57, the dimension of the top surface 57*a* in terms of the horizontal direction is desired to be no less than the maximum dimension of the discharge passage 48 in terms of the horizontal direction. In other words, it is desired to be no less than the diameter of the cylindrical discharge passage 48. In essence, all that is necessary is that the stairstep portion 57 is shaped and positioned so that it includes the bottommost point of the first inward surface 49*a*, the definition of which was given above, in terms of the circumferential direction of the conveyance passage 49.

Moreover, a stairstep portion 57A may be formed so that it extends along the inward surface of the entirety of the semi-circular bottom half of the conveyance passage 49 as shown in part (b) of FIG. 10, or a stairstep portion 57B may be formed so that it encircles the discharge passage 48 as shown in part (c) of FIG. 10, for the following reason. That is, it is possible that developer will become stagnant in the adjacencies of the stairstep portions 57A and 57B shown in part (a) of FIGS. 10 and 10(*b*), respectively, although it depends on the structure of a developing device.

Further, a stairstep portion 57C having two or more steps as shown in FIG. 11 may be formed on the first inward surface 49*a*. In the case of the stairstep portion 57C shown in FIG. 11, the number of steps is two. However, it may be three or more. Also in the case of the stairstep portion 57C shown in FIG. 11, it is formed so that the closer a step is to the stairstep surface 55, the higher the position of its top surface is. Even in this case, it is desired that the height H1 of the top surface of the second step in terms of the second direction, from the bottom surface of the stairstep portion 57C, satisfies the aforementioned inequality: $H1/H2 \geq 0.3$. Further, the length L of the stairstep portion 57C in terms of the first direction is desired to satisfy the inequality: $L/k \geq 0.3$.

At this time, the difference in the amount by which developer is made to agglomerate and agglutinate by a continuous image forming operation, between a developing device, such as the one in this embodiment, provided with the stairstep portion 57 which fills the developer stagnation area, and a developing device, such as the comparative developing device, which is not provided with the stairstep portion 57, is described.

In the case of an image forming apparatus equipped with the comparative developing device structured as shown in part (b) of FIG. 7, when it was used to continuously form images in an ambience which was 30° C. in temperature, it was while the 10000th sheet P of recording medium was conveyed that the large particles of toner attributable to developer agglutination began to soil the sheet P. In comparison, in the case of the image forming apparatus 100 equipped with the developing device 4 in this embodiment, when it was used to continuously form images in an ambience which was 30° C. in temperature, the soiling of images attributable to toner agglutination did not occur even after the conveyance of the 10000th sheet P.

As described above, in this embodiment, the adjacencies of the upstream end of the reverse screw 46*b* in terms of the second direction, where the lowest point of the inward surface of the opening 44*b*, and the lowest point of the inward surface of the conveyance passage 49, are different in vertical position, and where developer is likely to become stagnant, is provided with the stairstep portion 57 to fill the adjacencies. Thus, it is unlikely for developer to become stagnant in this area, that is, the adjacencies of where the lowest point of the inward surface of the opening 44*b* and the lowest point of the inward surface of the conveyance passage 49 are different in position in terms of the vertical direction. Therefore, toner (developer) is unlikely to agglomerate in this area. Therefore, it is possible to prevent the problem that a sheet of recording medium is soiled by large particles of toner generated by the toner (developer) agglutination. Therefore, it is possible to enable an image forming apparatus to reliably output desirable images for a long period of time.

Embodiment 2

Next, referring to FIG. 12, the second embodiment of the present invention is described. In this embodiment, a sloped portion 58 is provided as a means for raising the inward surface of the conveyance passage 49, in place of the stairstep portion 57 in the first embodiment. Otherwise, the developing device in this embodiment is the same in structure and function as the developing device 4 in the first embodiment. Therefore, the components of the developing device in this embodiment, and portions thereof, which are the same in structure, are given the same referential codes as those given to the counterparts in the first embodiment, and are only briefly described, or not described or illustrated at all. That is, this embodiment is described only about its differences from the first embodiment.

Referring to part (a) of FIGS. 12 and 12(*b*), in this embodiment, a sloped portion 58 is provided on the upstream side of the stairstep surface 55 in terms of the first direction (indicated by arrow mark γ). That is, the sloped portion 58 is shaped and positioned so that the lowest point of the first inward surface 49*a* gradually slopes upward from a point which is on the discharge passage side of the upstream end of the reverse screw 46*b* in terms of the second direction, toward the stairstep surface 55 which connects the bottommost point of the second inward surface 48*a* and bottommost point of the first inward surface 49*a*. Here, the sloped portion 58 makes up the downstream end portion of the first inward surface 49*a* in terms of the first direction.

Next, the structure of the sloped portion 58 in this embodiment is described in detail. Referring to part (a) of FIG. 12, a referential code L stands for the dimension (length) of the sloped portion 58 in terms of the direction parallel to the first inward surface 49*a*. A referential code H stands for the dimension (height) of the sloped portion 58 in terms of the vertical direction. A referential code 58*a* stands for the sloped surface of the sloped portion 58. The sloped surface 58*a* connects the upstream edge of the sloped portion 58 in terms of the first direction, and the top edge of the sloped portion 58, which coincides with the stairstep surface 55. It is slanted so that it gradually slopes upward toward the stairstep surface 55. That is, with the sloped surface 58*a* (sloped portion 58) being in position, the bottommost point of the first inward surface 49*a* gradually slopes upward toward the stairstep surface 55. In this embodiment, the developer stagnation area described above with reference to FIG. 8 is filled by the formation of the sloped portion 58.

More concretely, also in this embodiment, the distance k which is the distance in terms of the first direction, between the stairstep surface 55, and the upstream end of the reverse screw 46*b* in terms of the second direction is desired to be no less than 1.5 mm. In this embodiment, it is 2.5 mm.

Further, the length L of the sloped portion 58 in terms of the first direction is desired to satisfy an inequality: $L/k \geq 0.3$, for the following reason. That is, if L/k is no more than 0.3, it is difficult to prevent the problem that developer becomes stagnant, agglomerates, and is agglutinated into larger particles of developer (toner), in the adjacencies of the stairstep surface 55. Moreover, it is desired that an inequality: $k-L \geq 0.3$ mm is satisfied, for the following reason. If the distance between the upstream end of the reverse screw 46*b* in terms of the second direction and the sloped portion 58 is excessively small, it is possible that developer will agglomerate and is agglutinated into larger particles in the area between the reverse screw 46*b* and sloped portion 58.

Further, it is desired that an inequality: $H1/H2 \geq 0.3$ is satisfied, wherein, H1 stands for the height of the downstream end of the sloped surface 58*a* in terms of the first direction, and H2 stands for the height of the bottommost point of the second inward surface 48*a*, for the following reason. That is, if H1/H2 is no more than 0.3, the toner stagnation area is created, and therefore, it is difficult to prevent the problem that the stagnant developer in the developer stagnation area is agglutinated into larger particles of toner. Moreover, the height H1 of the sloped portion 58 is desired to be no less than 1.0 mm. Further, the length L of the sloped portion 58 is also desired to be no less than 1.0 mm.

If the length L of the sloped surface 58*a* is relatively short, the developing device 4 is desired to be structured as follows. That is, it is desired that the height H3 of the bottommost point of the second inward surface 48*a* of the discharge passage 48, relative to the downstream end of the sloped surface 58*a* in terms of the first direction is no less than 1.0 mm, for the following reason. That is, if the height H3 is no more than 1.0 mm, the sloped portion 58 is less effective to prevent the problem that the amount by which developer is discharged as it is scooped up by the reverse screw 46*b* becomes excessive.

In this embodiment, the sloped portion 58 is shaped so that its sectional view at a plane perpendicular to the rotational axis 46*d* of the second stirring-conveying screw 46 appears the same as stairstep portion 57 in the first embodiment, as shown in part (a) of FIG. 10. Needless to say, it may be shaped as shown in part (b) of FIG. 10 or 10(*c*). By the way, the sloped surface 58*a* of the sloped portion 58 may be made flat as shown in part (a) of FIG. 12, or concave in such a curvature that the more downstream it is in terms of the first direction, the higher. Also in this embodiment, the height H1 of the downstream end of the sloped surface 58*a* in terms of the first direction is made less than the height H2 of the bottommost point of the second inward surface 48*a*. However, such a structural arrangement is not mandatory. That is, the developing device may be structured so that H1 (height of downstream end of sloped surface 58*a* in terms of first direction) is the same as H2 (height of bottommost point of the second inward surface 48*a*). That is, the sloped portion 58 may be formed so that the sloped surface 58*a* is flat and directly connects the bottommost point of the first inward surface 49*a* and bottommost point of the second inward surface 48*a*, that is, without forming a stairstep portion.

By the way, in this embodiment, in order to fill the area on the upstream side of the reverse screw 46*b* in terms of the second direction, which corresponds in position to the area in which the position of the bottommost point of the inward surface of the discharge passage 48 and that of the conveyance passage 49 are different in height, and therefore, developer is likely to become stagnant, the sloped portion 58 is placed in this area. Thus, it is unlikely for developer to become stagnant in this area as in the case of the first embodiment. Therefore, it is unlikely for developer to agglomerate and agglutinate in this area. Therefore, it is unlikely for the image forming apparatus in this embodiment to output soiled images attributable to toner agglutination. That is, the image forming apparatus in this embodiment can continuously and reliably output desirable images for a long period of time.

According to the present invention, it is possible to prevent developer from becoming stagnant in the area in which, in terms of the vertical direction, the position of the bottommost point of the inward surface of the opening is different from that of the conveyance passage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-163112 filed on Aug. 20, 2015, which is hereby incorporated by reference herein in its entirety.

What is claimed is:

1. A developing apparatus comprising:

a developing container configured to contain a developer;

a stirring-conveying screw configured to feed the developer in said developer container, said stirring-conveying screw including:

a first feeding screw portion configured to feed the developer in a first direction;

a second feeding screw portion provided at a position downstream of said first feeding screw portion with respect to the first direction and configured to feed the developer in a second direction opposite to the first direction; and a third feeding screw portion provided downstream of said second feeding screw portion with respect to the first direction and having a radius smaller than a rotational radius of said second feeding screw portion, said third feeding screw portion being configured to feed the developer in the first direction;

a first feeding passageway accommodating parts of said first feeding screw portion, said second feeding screw portion, and said third feeding screw portion, and through which the developer is fed;

a second feeding passageway provided with a communication opening in fluid communication with said first feeding passageway, said second feeding passageway having a bottom portion at a level higher than a bottom surface of said first feeding passageway with respect to a vertical direction, said second feeding passageway accommodating said third feeding screw portion and through which the developer is fed;

a discharging portion provided in said second feeding passageway to permit discharge of the developer from said developing apparatus; and a bottom surface portion disposed at an end of said first feeding passageway proximate to said communication opening, said bottom surface portion having a first portion provided at a position higher than a bottom surface of said second feeding screw portion and a second portion provided at a position lower than a bottom-most portion of said communication opening, wherein said bottom surface portion is located downstream of said second feeding screw portion with respect to the first direction and faces said third feeding screw portion.

2. An apparatus according to claim 1, wherein a maximum height H1 of said bottom surface portion and a height H2 of the lower end of said opening satisfy, $$H1/H2 \geq 0.3.$$

3. An apparatus according to claim 1, wherein a length L of said bottom portion measured in the first direction, and a length k measured in the first direction between said opening and an upstream end portion of said returning screw with respect to the second direction satisfy, $$L/k \geq 0.3.$$

4. An apparatus according to claim 1, wherein said bottom portion includes a plurality of steps.

5. An apparatus according to claim 1, wherein said bottom portion includes an inclined portion which gradually ascends.

6. An apparatus according to claim 1, wherein said first feeding screw and said second feeding screw and said third feeding screw are integral with a common rotational shaft.

7. An apparatus according to claim 1, further comprising a bearing for rotatably supporting said feeding screw at a position downstream of said communication opening with respect to the first direction.

* * * * *